United States Patent [19]

Ludwig

[11] 4,339,743

[45] Jul. 13, 1982

[54] MULTIPLE RESISTANCE ELEMENT ASSEMBLY AND METHOD OF MAKING SAME

[75] Inventor: George C. Ludwig, Florence, S.C.

[73] Assignee: Tom McGuane Industries, Madison Heights, Mich.

[21] Appl. No.: 205,405

[22] Filed: Nov. 10, 1980

[51] Int. Cl.[3] ..... H01C 3/00

[52] U.S. Cl. ..... 338/206; 29/610 R; 338/320

[58] Field of Search ..... 338/206, 208, 260, 320, 338/315, 319, 280, 279, 283, 284, 287–289, 290; 29/610 R, 611, 612; 219/375, 381, 552–553

[56] References Cited

U.S. PATENT DOCUMENTS

| | | | |
|---|---|---|---|
| 1,991,935 | 2/1935 | Melsom | 338/206 |
| 2,023,517 | 12/1935 | Creager et al. | 338/322 X |
| 2,087,573 | 7/1937 | Hamilton | 338/206 |
| 2,879,363 | 3/1959 | Mucher | 338/320 X |
| 3,253,244 | 5/1966 | Hoy et al. | 338/316 X |

*Primary Examiner*—C. L. Albritton
*Attorney, Agent, or Firm*—Remy J. VanOphem

[57] ABSTRACT

A multiple resistance element assembly having two parts, an insulator base and a multiple resistance element having expanded metal resistance members. The ends of the expanded metal resistance members are serially connected by contiguous non-expanded metal sections joining the ends of adjacent members. Tabs formed from contiguous non-expanded metal are bent normal to the plane of the resistance members and are inserted into mating slots formed in the base, and lock the multiple resistance element to the base.

22 Claims, 8 Drawing Figures

MULTIPLE RESISTANCE ELEMENT ASSEMBLY AND METHOD OF MAKING SAME

BACKGROUND OF THE INVENTION

I. Field of the Invention

The invention is related to multi-resistance element assemblies, and in particular to the multi-resistance element assemblies used to vary the speed of small D.C. motors.

II. Description of the Prior Art

Often it is desirable to have the speed of small D.C. motors variable to accommodate different conditions. For example, it is desirable to operate the windshield wiper of an automotive vehicle at a fast speed during a heavy rain, and at a lower speed during a light rain or drizzle. Likewise, it is desirable to operate a defroster, heater, or airconditioning fan of an automotive vehicle at various speeds for comparable reasons. Presently, there are several ways to vary the speeds of these motors. One is to use multiple field windings within the motor itself, such as used in two speed windshield wiper motors of present day vehicles. This requires additional field windings within the motor itself increasing its cost. Because of cost considerations, the method is usually limited to two speeds. For motors requiring less power, such as fan motors, the prior art teaches placing or switching one or more resistances in series with the motor to change the motor's speed. Because the current requirements of the small D.C. motors are still relatively high, the prior art uses coils of resistance wire such as nichrome or similar alloys, having the desired resistance. Although the fabrication of the individual components is relatively inexpensive, a typical three-resistance element assembly will require at least seven (7) individual parts which have to be fastened together. With the high cost of labor, the labor for the final assembly of the multi-resistance assembly represents the majority of its cost. The disclosed invention is a resistance element assembly which comprises only two parts which may be snapped together without the use of special tools or fixtures, thereby providing a significant reduction of labor costs.

The key to the invention is an expanded metal resistance element as taught by S. W. Melson in U.S. Pat. No. 1,991,935. Melson teaches the use of the expanded metal as a resistive element for small motors or similr devices in which the expanded metal is formed into a tubular shape. Bolt holes are formed in the unexpanded portion for mounting and electrical connection purposes. For multiple resistance element devices, Melson further teaches slitting or cutting a slit through the non-expanded portion and its contiguous expanded portion from one end, then cutting a second slit through the non-expanded portion and its contiguous portion from the other end. Multiple slits may be cut in an alternating sequence to form the desired number of resistance elements. The unslit non-expanded portions serially connect adjacent expanded resistive elements. The expanded portions are then bent into tubular form and the unexpanded portions formed into mounting tabs. The final assembly comprises a bolt and a number of insulators and spacers which hold the resistive elements spaced from each other without deformation. Another type of resistive element is taught by Schaefer in U.S. Pat. No. 2,422,542, in which a resistive woven wire grid is soldered to electrical terminals. The use of expanded metals in resistive heating devices is taught by Horsfall et al. in U.S. Pat. No. 3,543,970, Maake in U.S. Pat. Nos. 3,798,419 and 3,860,789, Seel in U.S. Pat. No. 3,835,435, Schladitz in U.S. Pat. No. 3,843,950, and Ballard in U.S. Pat. No. 4,100,395.

SUMMARY OF THE INVENTION

The invention is a multiple resistive element assembly for a small D.C. motor such as a fan motor in an automotive vehicle comprising only two parts. The first part is an insulator base have a plurality of parallel slots disposed therethrough, and an expanded metal multi-resistance element. The expanded metal resistance element has non-expanded portions on each end and is slotted to form a desired number of serially connected resistive elements. The non-slotted segment of the non-expanded portion defining the serial connection between adjacent resistive elements are formed into tabs bent normal to the surface of the resistive elements and adapted to be received in the parallel slots disposed in the insulator base. Shoulders on the tabs, larger than the slots define the stand-off height of the resistive elements above the insulator base. In the preferred embodiment, the ends of the tabs are folded back on themselves to form a snap lock engaging the bottom surface of the insulator base after the tabs have been inserted through the slots. Alternatively, as is known in the art, the tabs may be twisted or shear staked in place.

The object of the invention is a multiple resistive element assembly having only two pieces which are easy to assemble, thereby resulting in significant labor cost savings. Another object of the invention is a multiple resistive element which is easy to assemble without requiring special tools or fixtures. Still another object of the invention is a multiple resistive element which is more reliable and less expensive than the prior art.

These and other objectives will become apparent from a reading of the specification in conjunction with the accompanying drawings.

DETAILED DESCRIPTION OF THE PREFERRED EMBODIMENT

I. Prior Art Multi-Resistive Element

Figure 1:
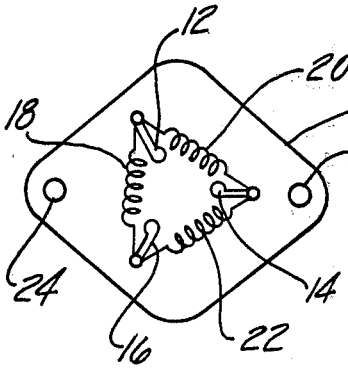
Fig-1 PRIOR ART
FIG. 1 is a plan view of a multiple resistance element assembly of the prior art using resistive wire coils.

Referring first to FIG. 1, there is shown a prior art multi-resistive element assembly of the type presently used for the fan motor of automotive vehicles. The multi-resistive element assembly comprises a rhombic shaped insulator base 10 made from a plastic or selfextinguishing fiberglass board. Attached to the base 10 are three stand-offs 12, 14, and 16, which also serve as electrical terminals protruding from the under side of the base. Connected between the three stand-offs 12, 14 and 16 are three resistive wires wound in the forms of coils 18, 20, and 22. The ends of the coils are either crimped in cylindrical receptacles provided in the stand-offs 12, 14, and 16 or welded to them as is known in the art. Two mounting holes 24 and 26 are disposed proximate the opposite corners along the major axis. The prior art multi-resistive element assembly is comprised of at least seven (7) parts which must be individually joined in the final assembly. As previously discussed, the assembly labor is the largest cost item in the fabrication of this type of multi-resistance element assembly.

II. Disclosed Multi-resistive Element Assembly

Figure 4:
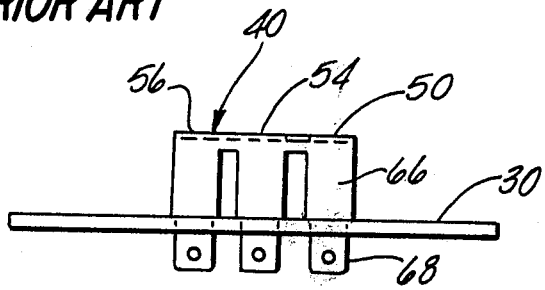
FIG. 4 is a side view of the multi-resistance element assembly.
Figure 3:
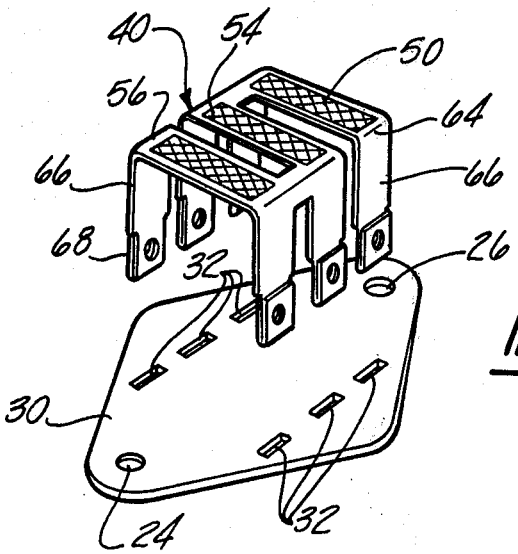
FIG. 3 is an exploded perspective showing the assembly of the multi-resistance element to the base.
Figure 2:
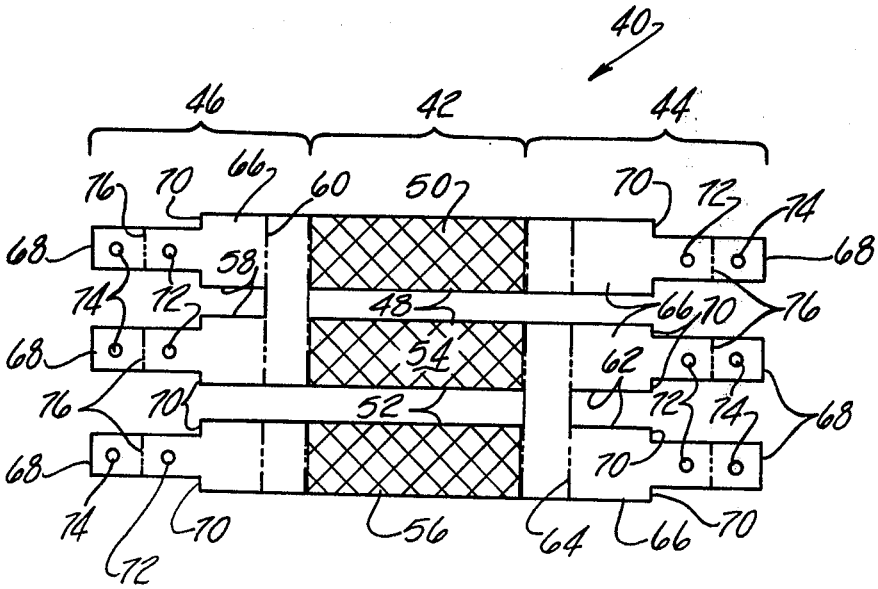
FIG. 2 is a plan view of the expanded metal resistance element.

The disclosed multi-resistive element assembly is shown in FIGS. 3 and 4 and comprises a base 30 illustrated on FIG. 3 and the expanded metal multi-resistive element 40 shown in FIG. 2. Referring first to FIG. 3, the base 30 is made from a fire retardant fiberglass board and has the same rhombic shape as that of the prior art's base 10, with mounting holes 24 and 26 proximate the opposite corners of the major axis. A plurality of tab slots 32 are formed through the base in a symmetrical pattern along two parallel lines. In a three-resistance element assembly, there would be six tab slots 32 as shown.

The details of the expanded metal multi-resistance element 40 before bending to the desired shape are shown in FIG. 2. Referring to FIG. 2, the expanded metal element 40 has an expanded metal control section 42 with non-expanded end sections 44 and 46. The three-resistance element illustrated in FIG. 2 has a first slot 48 cut through the non-expanded section 44 and expanded central section 42 forming a first resistance element 50. A second slot 52 is cut through the non-expanded end section 46 and the expanded central section 42 to form the other two resistance elements 54 and 56. A third slot 58 is cut part way through the non-expanded end section 46 in line with slot 48 extending inwardly to a first bend line indicated by dashed line 60. A fourth slot 62 is cut part way through the non-expanded end section 44 in line with slot 52 extending inwardly to a second bend line indicated by dashed line 64. The resistivity of the individual resistance elements 50, 54 and 56 is determined by their respective widths.

The four slots 48, 52, 58 and 62 divide the non-expanded end sections 44 and 46 into six tabs. Each tab has a stand-off section 66 and a tab insert 68. The widths of the stand-off sections 66 are greater than the lengths of the slots 32 formed through the base 30. The widths of the tab inserts 68 are slightly narrower than the length of the tab slots 32. Stand-off shoulders 70 are formed at the junction between the stand-off sections 66 and the tab inserts 68. The stand-off sections 66 may be indented equally from both sides to form the tab inserts 68 as shown, or as is known in the art, the stand-off section 66 may be indented on one side only.

Two apertures 72 and 74 are formed through each tab insert 68 such that when the tab insert 68 is folded back on itself along fold line 76 to form a snap lock, the two holes form a single aperture.

Referring now to FIG. 3, the tabs are bent at right angles to the plane of the expanded resistance elements 50, 54 and 56 along lines 60 and 64, as shown, and the tab inserts 68 are folded back on themselves along the fold line 76 to form snap locks at their ends. In this configuration each tab insert 68 is registered with one of the tab slots 32. In the folding of the tab insert 68, the end 78 folded portion 80 is disposed at a small angle with respect to the unfolded portion 82 as shown on FIG. 5.

Figure 5:
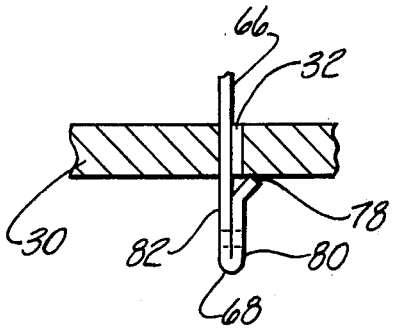
FIG. 5 is an enlarged partial cross section showing the tab insert configured as a snap lock.

The assembly of the multi-resistive element comprises inserting the tab inserts 68 into their corresponding tab slots 32 and pressing the two parts together until the stand-off shoulders 70 engage the top surface of the base 30. As the two parts are pressed together, the ends 78 of the tab inserts 68, forming the snap lock are compressed against the unfolded portions 82 by the walls of tab slots 32 permitting the tab inserts 68 to pass through the slots. The folded portions 80 are dimensioned so that when the stand-off shoulders 70 rest on the top of base 30, the ends 78 just clear the bottom surface of the base 30. When the ends 78 of the tab inserts 68 clear the bottom surface of the base, they spring back to their original angular position, locking the multi-resistive element 40 to the base 30 as shown in FIG. 5. The completed assembly is shown in FIG. 4.

Figure 6:
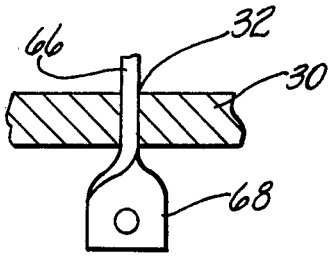
FIG. 6 is an enlarged partial cross section showing the bottom of the tab insert twisted to lock the multi-resistance element to the base.
Figure 7:
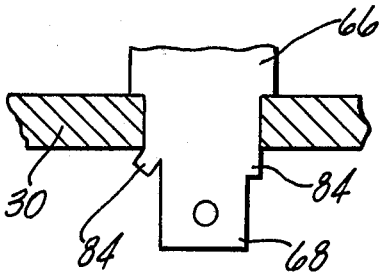
FIG. 7 is an enlarged partial cross sectional view showing tab insert shear staked to lock the multi-resistance element to the base.

FIGS. 6 and 7 show alternate ways of locking the multi-resistance element 40 to the base 30. Referring first to FIG. 6, the folded portion of the tab insert 68 forming the snap lock is eliminated and the locking of the two parts together is accomplished by twisting the end of the tab insert protruding from the bottom of the base. The end of the tab insert may be twisted to any angle which will produce the desired locking force as is known in the art. Alternatively, the tab insert 68 may be shear staked as illustrated in FIG. 7. In this configuration, a second shoulder 84 is formed on both sides of the tab inserts 68 which protrudes slightly below the bottom surface of the base 30 when the stand-off shoulders 70 are resting on the top surface of the base. The protruding portions of the second shoulder 84 are then shear staked to deform the protruding portion as illustrated by the deformed second shoulder 84 when on the left side of the tab insert. Although the snap lock configuration illustrated with reference to FIG. 5 is preferred since it requires no special tools or additional operations to complete the assembly, the locking methods illustrated with reference to FIGS. 6 and 7 are contemplated within the spirit and intent of the invention.

Figure 8:
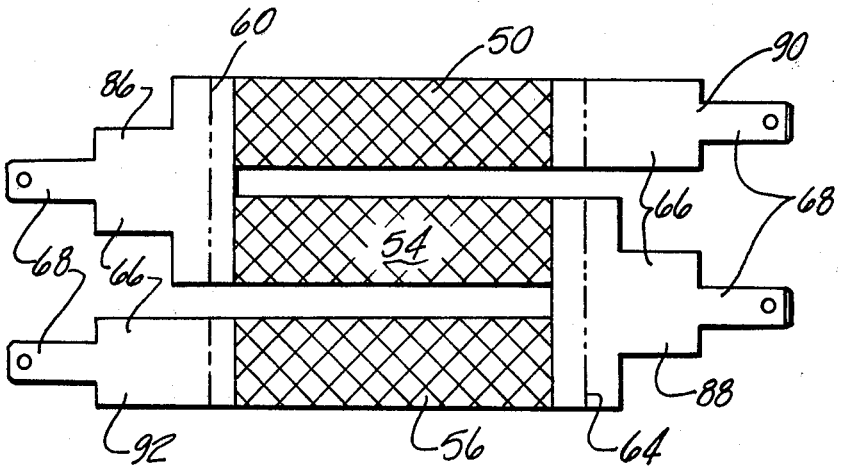
FIG. 8 is a plan view of an alternate configuration of the multi-resistance element.

An alternate configuration of the multi-resistance element 40 is illustrated in FIG. 8. The basic structure of this multi-resistance element is the same as that shown in FIG. 2 except that the number of tabs is reduced from six (6) to four (4) by combining the two tabs having a common edge in single tabs 86 and 88, as shown. The two end tabs 90 and 92 are the same as the two tabs shown on FIG. 2. Obviously, the number of tab slots 32 formed through the base 30 will likewise be reduced from six (6) to four (4).

The embodiment of the multi-resistive element of FIG. 8 will be bent into the configuration shown in FIG. 3, and the assembly procedures will be the same as discussed above. Any of the locking mechanisms illustrated in FIGS. 5, 6 and 7 may, likewise, be used.

Having described the invention with respect to embodiments illustrated, it is recognized that alternate embodiments may be conceived by a person skilled in the art without departing from the spirit of the invention. It is not intended that the invention be limited to the embodiments shown or assembly procedures discussed.

What is claimed is:

1. A multiple resistance element assembly comprising:

a planar insulator base having two parallel surfaces; and a multiple resistance element attached to said base, said multiple resistance element having a plurality of expanded metal resistance members disposed parallel to each other and serially connected by contiguous non-expanded metal interconnections joining the ends of adjacent resistance members in an alternating sequence, said non-expanded metal interconnections further providing means for fixedly supporting said plurality of resistance members a predetermined distance above one parallel surface of said base and for providing separate electrical terminals to the opposite ends of each resistance member protruding from the other parallel surface of said base.

2. The multiple resistance element assembly of claim 1, wherein said means for supporting comprises a plurality of non-expanded metal tabs contiguous with said non-expanded metal interconnections and disposed normal to said resistance members, each of said tabs having a stand-off section adjacent to said resistance members, said stand-off section having a length equal to said predetermined distance and a first width, said tabs further including a tab insert section having a length greater than the distance between the parallel surfaces of the base and a second width narrower than said first width; and wherein said base has a plurality of slots formed therethrough between said parallel surfaces equal in number to said plurality of tabs, said slots being disposed through said base in register with said tabs, and each slot having a length sufficient to pass only said tab insert sections therethrough.

3. The multiple resistance element assembly of claim 2 wherein said plurality of tabs includes one tab at each end of each expanded metal resistance member.

4. The multiple resistance element assembly of claim 2 wherein said plurality of tabs includes one tab at each end of said serially connected expanded metal resistance members and one tab contiguous with each of said non-expanded metal interconnections joining the ends of adjacent expanded metal resistance members.

5. The multiple resistance element assembly of claim 3 or 4 wherein the insert sections are configured in the form of a snap lock securing said multiple resistance element to said base with said stand-off section abutting said one parallel surface.

6. The multiple resistance element assembly of claim 3 or 4 wherein the ends of said tab insert sections protruding from the other surface of said base are twisted to secure said multiple resistance element to said base with stand-off section abutting said one parallel surface.

7. The multiple resistance element assembly of claim 3 or 4 wherein the portion of said tab insert sections protruding from the other parallel surface of the base is shear staked to a width greater than the width of said slots to secure said multiple resistance element to said base with said stand-off sections abutting the one parallel surface.

8. The multiple resistance element assembly of claim 3 or 4 wherein said plurality of resistance members is three resistance members.

9. A method for making a multiple resistance element assembly comprising the steps of:

cutting from a sheet, having an expanded metal central portion and contiguous non-expanded end portions, a multiple resistance element having a plurality of expanded metal resistance members disposed parallel to each other and serially connected by contiguous metal interconnections joining the ends of adjacent resistance members and further including a plurality of non-expanded metal tabs contiguous with and extending outwardly from said resistance members, said tabs having a stand-off section adjacent to ends of said resistance members having a first length and a first width, and a tab insert section having a second length and a second width smaller than said first width;

bending said tabs normal to the surface of said parallel resistance members;

forming a base member having a plurality of tab slots formed therethrough from a sheet of insulation material having a thickness significantly less than the second length of said tab insert section, said tab slots arranged in a pattern to receive said plurality of tab insert sections and each slot having a length sufficient to pass only said tab insert sections therethrough; and locking said multiple resistance element to said base with said tab insert sections passing through said tab slots and said standoff sections abutting one side of said base member.

10. The method of claim 9 wherein said method further includes the step of bending each of said tab insert sections to form a snap lock on the ends thereof; said step of locking includes the steps of:

inserting said tab insert sections into said tab slots; and pressing together said multiple resistance element and said base member to cause said snap locks to engage the other side of said base member and locking said multiple resistance element thereto.

11. The method of claim 9 wherein said step of locking includes the steps of:

inserting said tab insert sections into said tab slots; and twisting the ends of said insert sections protruding from the other side of said base member to lock said multiple resistance members to said base members.

12. The method of claim 9 wherein said step of locking includes the steps of:

inserting said tab insert sections into the tab slots; and shear staking the sides of the tab insert sections protruding from the other side of the base to deform the protruding portion of the tab insert sections locking said multiple resistance element to said base member.

13. The method of claim 9 or 10 wherein the multiple resistance member formed by said step of cutting has three resistance members.

14. The method of claim 11 or 12 wherein the multiple resistance element cut from said sheet in said step of cutting has three resistance members.

15. A multi-element resistance assembly comprising:

an insulator base having a plurality of slots arranged in a predetermined pattern; and a multiple resistance element having a plurality of expanded metal resistance members disposed parallel to each other and serially interconnected to each other by non-expanded metal members, said multiple resistance element further including a plurality of contiguous non-expanded metal tabs associated with the ends of said resistance members and extending normal thereto, said tabs forming a series of support members arranged in the same predetermined pattern as the slots in said insulator base, each of said tabs having a stand-off section defining a predetermined separation of said resistance members from said insulator base and a tab insert section passing through said slots in said base and said tab insert sections including means for fastening said multiple resistance element to said insulator base.

16. The multi-element resistance assembly of claim 15 wherein a tab is disposed at each end of said resistance member.

17. The multi-element resistance assembly of claim 15 wherein one tab is associated with each end of said serially connected resistance members and one tab is associated with each non-expanded metal members serially interconnecting said resistance members.

18. The multi-element resistance assembly of claim 16 or 17 wherein said tab insert section is folded into the shape of a snap lock, said snap lock securing said multiple resistance element to said base member.

19. The multi-element resistance assembly of claim 16 or 17 wherein the tab insert sections protrude from the base member on the sides opposite said resistance members and wherein the protruding sections of the tab insert sections are twisted to lock said multiple resistance element to said base member.

20. The multi-element resistance assembly of claim 16 or 17 wherein said tab insert sections protrude from the side of said base member opposite said resistance members, and wherein said protruding portions of said tab insert sections are shear staked to deform the protruding portions locking said multiple resistance element to said base member.

21. A multiple resistance element comprising:

a plurality of expanded metal resistance members disposed parallel to each other;

contiguous non-expanded metal members serially interconnecting said plurality of resistance members;

non-expanded metal tab members contiguous with the ends of said non-expanded metal members and disposed normal thereto, each tab member having a stand-off section on the end adjacent to the ends of said resistance members, and a terminal section formed at the ends of said tabs on the end opposite said resistance members.

22. The multiple resistance element of claim 21 wherein each terminal section has a folded end portion forming a snap lock at the end of each tab.

* * * * *

UNITED STATES PATENT AND TRADEMARK OFFICE

CERTIFICATE OF CORRECTION

PATENT NO. : 4,339,743

DATED : July 13, 1982

INVENTOR(S) : George C. Ludwig

It is certified that error appears in the above-identified patent and that said Letters Patent is hereby corrected as shown below:

Column 4, line 52, after "two" (second occurrence) insert

---- end ----.

Signed and Sealed this

*Twelfth* Day of *July 1983*

[SEAL]

*Attest:*

GERALD J. MOSSINGHOFF

*Attesting Officer*

*Commissioner of Patents and Trademarks*